US005429484A

United States Patent [19]

Honda et al.

[11] Patent Number: 5,429,484

[45] Date of Patent: Jul. 4, 1995

[54] LIQUID FEED PUMP PARTICULARLY USED FOR LIQUID MEDICINE AND LIQUID FEED APPARATUS FOR FILLING OF LIQUID MEDICINE

[75] Inventors: Washiro Honda, Honjo; Masahiko Nakazawa; Hisayoshi Matsumoto, both of Osaka, all of Japan

[73] Assignee: Eisai Co., Ltd., Tokyo, Japan

[21] Appl. No.: 132,956

[22] Filed: Oct. 7, 1993

[30] Foreign Application Priority Data

Oct. 14, 1992 [JP] Japan ..... 4-301773
Jul. 19, 1993 [JP] Japan ..... 5-177718

[51] Int. Cl.[6] ..... F15B 15/24

[52] U.S. Cl. ..... 417/398; 92/13.2; 92/13.7

[58] Field of Search ..... 417/398, 413 R; 92/13.2, 13.7

[56] References Cited

U.S. PATENT DOCUMENTS

| | | | |
|---|---|---|---|
| 862,867 | 8/1907 | Eggleston | 417/472 X |
| 1,885,436 | 11/1932 | Hampton | 417/413 R |
| 2,803,195 | 8/1957 | Lock | 417/398 |
| 2,948,221 | 8/1960 | Carver | 92/13.2 X |
| 3,354,830 | 11/1967 | Mortara | 92/13.7 X |
| 4,167,896 | 9/1979 | Clements | 92/13.2 X |
| 4,391,291 | 7/1983 | Hume | 92/13.7 X |

*Primary Examiner*—Richard E. Gluck
*Attorney, Agent, or Firm*—Griffin, Butler Whisenhunt & Kurtossy

[57] ABSTRACT

A metallic diaphragm is provided within a pump chamber. This diaphragm is oscillated by a stem to Feed liquid medicine. The stem is provided with a plate and a movement of this plate, i.e., a stroke of the stem is limited by a pair of stoppers. Relative position of the paired stoppers at which they limit the stroke is adjusted by providing the paired stoppers with threads which are handed reversely to each other so that the paired stoppers are moved by amounts equal to each other during a change of the relative position. The stem carries thereon a piston which is, in turn, vertically movable within a cylinder chamber into which compressed air is introduced to oscillate the stem. A plurality of such pumps are successively connected one to another, stop valves are connected upstream as well as downstream off the respective pumps and a suck-back pump of the same construction as the liquid feed pump is connected immediately before a liquid filling device.

6 Claims, 4 Drawing Sheets

LIQUID FEED PUMP PARTICULARLY USED FOR LIQUID MEDICINE AND LIQUID FEED APPARATUS FOR FILLING OF LIQUID MEDICINE

BACKGROUND OF THE INVENTION

This invention relates to a liquid feed pump particularly used in an apparatus for filling an ampule or the like with liquid medicine and a liquid feed apparatus utilizing such liquid feed pump to perform such operation of liquid medicine filling.

Most commonly a pump of the piston type, made of metal and glass, has been used for filling of liquid medicine. Though not extensively, a diaphragm pump made of synthetic resin also has been used as simplified filling equipment.

Additionally, a pump of piston type adapted for CIP (Clean In Place) and SIP (Sterile In Place) is also commercially available. The pump of the piston type is disadvantageous in that a slidable movement of the piston with respect to the cylinder is apt to generate particles. Presence of the parts which are slidably movable often results in deteriorating the surface of the pump chamber destined to be exposed to the liquid medicine and makes it impossible to achieve a satisfactory washing effect unless the pump is dismantled and subjected to ultrasonic washing or the like.

Such problem encountered by the pump of the piston type can be solved by the diaphragm pump which includes no slidably movable part. The diaphragm pump is well known in which the metallic diaphragm provided within the pump chamber is reciprocated so as to change a volume of the pump chamber and thereby the quantity of liquid that has been sucked through the liquid inlet into the pump chamber and is discharged through the liquid outlet.

A. Japanese patent application Disclosure Gazette No. 1979-108003 discloses a pumping apparatus for proportional control of a micro flow rate so arranged that a metallic diaphragm magnetically attracted by an iron core under an exciting effect of a solenoid coil bears against an O-ring secured to the upper end of the iron core. In this pump well known to the art, the metallic diaphragm is reciprocated with a predetermined stroke and a frequency of electric signals may be changed to change a repetition rate at which the metallic diaphragm is reciprocated and thereby to change a flow rate of the fluid.

B. Japanese patent application Disclosure Gazette No. 1988-176679 discloses a piezo-electric pump utilizing a laminated piezo-electric element to drive the diaphragm so as to achieve suction and discharge of fluid.

However, these conventional pumps utilizing the metallic diaphragms are inconvenient in that the desired liquid feed can be achieved only at a small flow rate since the diaphragms used in these pumps disadvantageously have small strokes.

More specifically, the above-mentioned pumping apparatus A is constructed so that the metallic diaphragm is magnetically attracted by the iron core under the exciting effect of the solenoid coil and, when the solenoid coil is not energized, a movable plate pushes the metallic diaphragm upward under a force of a spring and thereby changes a volume of the pump chamber. The invention of this Disclosure Gazette leaves unsolved a problem that a desired large stroke cannot be obtained only by the magnetic attraction of the metallic diaphragm under the exciting effect since the metallic diaphragm inherently has a high rigidity.

In addition, the invention of this Disclosure Gazette wherein a metallic diaphragm magnetically attracted under an exciting effect bears against an O-ring, leaves another problem unsolved such that the stroke is not stabilized and therefore it is difficult to maintain a quantity of liquid to be fed at a constant level since the O-ring against which the metallic diaphragm bears upon excitation of the solenoid coil is made of elastic material such as synthetic resin or rubber.

The above-mentioned piezo-electric pump B is also disadvantageous in that the length of the stroke is severely restricted and it is impossible to assure a constant quantity of liquid to be fed since the stroke relies upon expansion and contraction of a laminated piezo-electric element which is applied with voltage.

As far as washing and sterilization are concerned, the pump of a metallic diaphragm making CIP as well as SIP possible is preferred as the liquid feed means, particularly for liquid medicine, to that of the pump of the piston type which can neither be washed nor sterilized without dismantling the pump. However, it is difficult for the conventional metallic diaphragms as employed in the above-mentioned prior art to assure a constant quantity of liquid to be fed and the pump employing such metallic diaphragm, well known to the art, cannot satisfactorily function as the liquid feed means particularly for filling of liquid medicine. It should be also understood that various containers such as an ampule and a vial cannot be accurately filled with liquid medicine merely by employing the liquid feed pump of the diaphragm type since dripping of the liquid medicine out of the filling needle occurring before and after filling cannot be avoided.

SUMMARY OF THE INVENTION

It is an object of the invention to provide a liquid feed pump particularly suitable for liquid medicine which allows a constant quantity of liquid being fed to be assured by selecting an adequately large stroke of the metallic diaphragm pump and making both CIP and SIP possible.

It is another object of the invention to provide a filling apparatus for liquid medicine being free from liquid dripping.

The first object set forth above is achieved according to the invention, by a liquid feed pump used for liquid medicine, said liquid feed pump comprising: a pump chamber provided with a metallic diaphragm, a stem provided with drive means adapted to oscillate said diaphragm; and a pair of stops limiting a stroke of the stem and including means to adjust a relative position of the paired stops at which they limit the stroke of the stem.

Preferably, said stem is provided with a plate so that a movement of said plate is limited by a pair of stops.

Preferably, the relative position of the paired stops at which they limit the stroke of the stem is adjusted by providing the paired stops with mutually reverse-handed threads, respectively, so that the paired stops are relatively moved by amounts equal to each other during a change of said relative position.

Preferably, the stem carries thereon a piston which is, in turn, vertically movable within a cylinder chamber into which compressed air is introduced to oscillate the stem.

The liquid feed pump of the invention provides an effect as will be described.

The liquid feed pump of the invention utilizes oscillation of the metallic diaphragm to achieve filling with an exactly constant quantity of liquid medicine being fed. The quantity of liquid medicine to be fed is adjusted by relatively moving the paired stops by amounts equal to each other so as to change a stroke of the stem serving to oscillate the diaphragm. With a consequence, an equal force is exerted on the diaphragm in opposite directions, not only allowing the stroke to be sufficiently enlarged but also extending the life span of the metallic diaphragm since the diaphragm is made thereby free from metal fatigue.

The metallic diaphragm is more stable than the diaphragm made of synthetic resin against a change in pressure as well as temperature and therefore assures an accurate and stabilized liquid feed.

The pump chamber through which the liquid medicine passes contains no slidably movable part and the surface of the diaphragm destined to be exposed to the liquid medicine has been subjected to electrolytic polishing. As a result, the diaphragm is free from wearing and therefore the liquid medicine is not contaminated with metallic particles. Furthermore, both washing and sterilizing can be effectively performed without dismantling of the pump.

Moreover, the liquid feed pump of the invention allows a considerably larger quantity of liquid to be fed in comparison with the conventional liquid feed pump and allows an accurately controlled quantity of liquid to be discharged.

The second object set forth above is achieved, according to the invention, by connecting stop valves upstream and downstream of the respective liquid feed pumps and connecting a suck-back pump of the same construction as said liquid feed pump immediately before a liquid medicine filling device.

In this way, the invention realizes a liquid feed apparatus for filling of liquid medicine being free from liquid dripping, able to be washed and sterilized without dismantling, and assuring a high filling accuracy.

BRIEF DESCRIPTION OF THE DRAWINGS

The above and other objects of the invention will be seen by reference to the description taken in connection with the accompanying drawings, in which.

DETAILED DESCRIPTION OF THE INVENTION

Referring to the respective figures, an embodiment of the invention will be described.

First, a liquid feed pump will be described.

Figure 1:
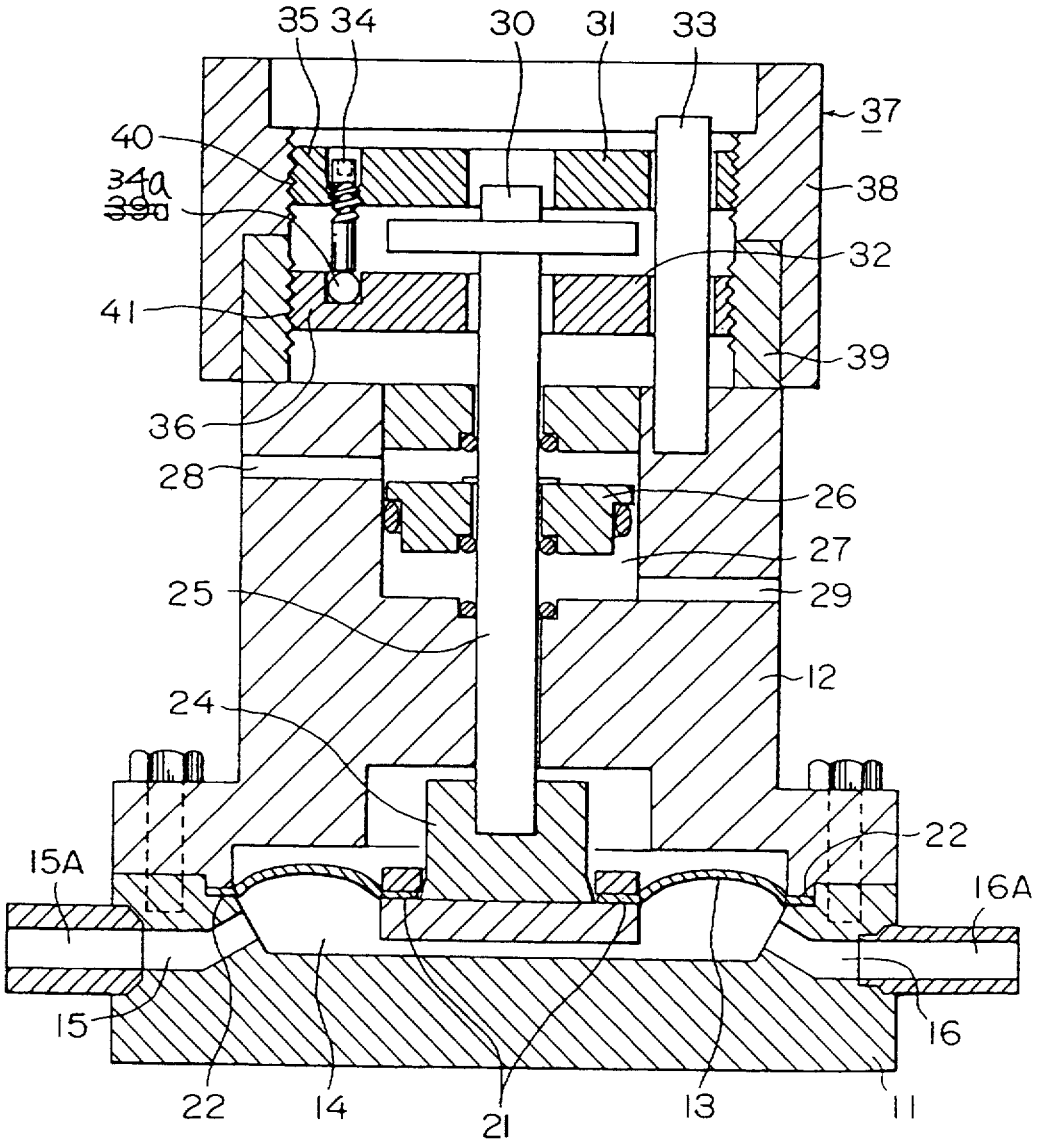
FIG. 1 is a sectional view taken along a line I—I in FIG. 2 showing a liquid feed pump constructed according to the invention particularly to be used for liquid medicine.
Figure 2:
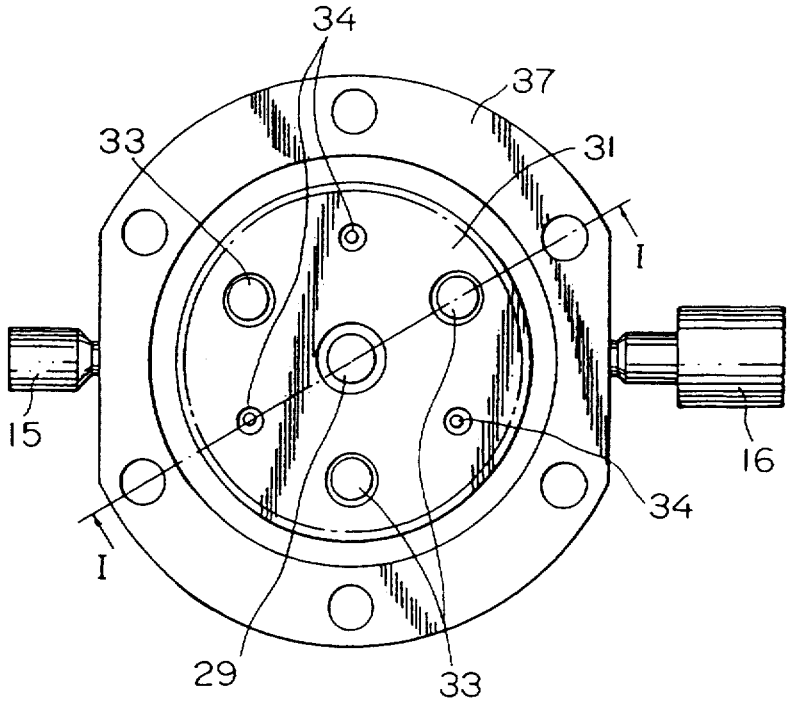
FIG. 2 is a plan view of the liquid feed pump shown by FIG. 1.

Referring to FIGS. 1 and 2, the liquid feed pump is illustrated in an axially sectional view and in a plan view, respectively.

A container 11 and a bonnet 12 hold therebetween a diaphragm 13 so that the underside of the diaphragm 13 defines a space serving as a pump chamber 14. The pump chamber 14 has a liquid inlet 15 and a liquid outlet 16 to which a liquid suction passage 15A and a liquid discharge passage 16A are connected, respectively. Both the liquid inlet 15 and the liquid outlet 16 are provided so as to slope downwardly as they extend away from the pump chamber 14.

Figure 3:
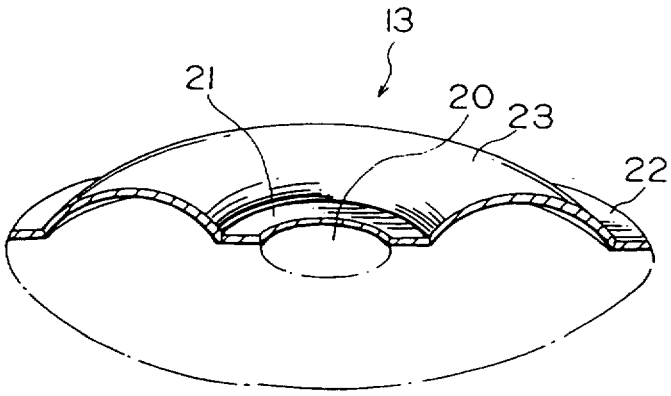
FIG. 3 is a perspective view showing, as partially broken away and partially in a section, a diaphragm used in the liquid feed pump shown by FIG. 1.

The diaphragm 13 is made of spring steel such as INCONEL (Registered Trademark of Ni—Cr—Fe alloy manufactured by Henry Wiggins). Referring to FIG. 3, the diaphragm 13 is centrally provided with a circular opening 20. The diaphragm 13 includes a flange 21 extending around the circular opening 20 and a flange 22 extending along its outer periphery. A convex cone 23 extends between these flanges 21, 22.

Both the container 11 and the bonnet 12 are made of an anti-rust material, for example, stainless steel, preventing them from being rusted and corroded by the liquid medicine.

On the other hand, the upper surface of the container 11 and the lower surface of the diaphragm 13 defining together the pump chamber 14 are sufficiently polished to facilitate washing of them.

As seen in FIG. 1, the diaphragm 13 is held between the container 11 and the bonnet 12 by flange 22 of the diaphragm 13 being mechanically held between them and the diaphragm supports at its center a stem 25 by a disc which holds the flange 21 of the diaphragm 13.

The stem 25 carries at its intermediate level a piston 26 contained within a cylinder chamber 27 which is, in turn, defined within the bonnet 12. There are provided air passages 28, 29 in fluid communication with the cylinder chamber 27. Compressed air is supplied alternately through these air passages 28, 29 into the cylinder chamber 27 so that the piston 26 is repetitively moved up and down and thereby the diaphragm 13 integrally connected to the lower end of the stem 25 is vertically oscillated.

The stem 25 is provided adjacent the upper end thereof with a plate 30 and a movement of this plate 30 is limited by an upper stop 31 and a lower stop 32. These stops 31, 32 are vertically movable along rods 33 fixed to the bonnet 12 but not rotatable therearound. Screws 34 are threaded into the upper stop 31 and the lower ends of the respective screws 34 depress the upper surface of the lower stop 32 through the aid of balls **34*a* received in pits formed in the upper surface of the lower stop 32**.

As seen in FIG. 2, there are provided three rods 33 and three screws 34.

The upper and lower stops 31, 32 are provided around their outer peripheries with threads 35, 36, respectively. These threads 35, 36 are of a same pitch but of directions opposite to each other, i.e., if the thread 35 is right-handed, then thread 36 will be left-handed and, if the thread 35 is left-handed, then thread 36 will be right-handed.

Figure 4:
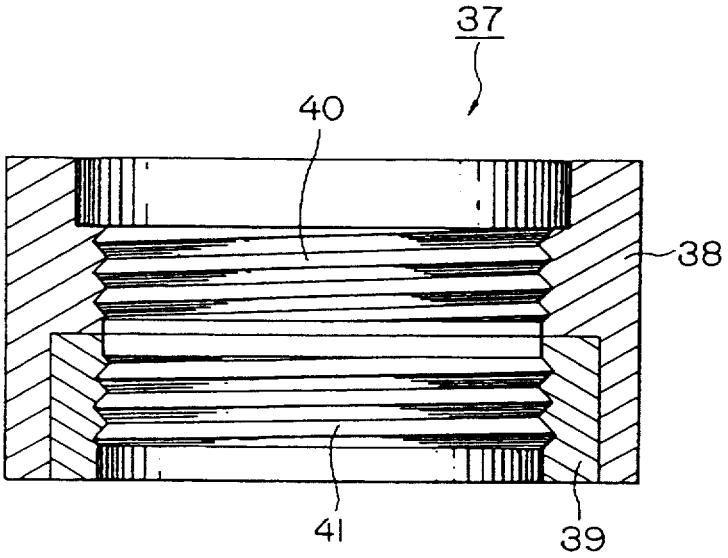
FIG. 4 is a fragmentary view showing, in an axial section, a ring 37 used in the liquid feed pump of FIG. 1.

These upper and lower stops 31, 32 are surrounded by a ring 37. As shown by FIG. 4, the ring 37 comprises a main ring 38 and an auxiliary ring 39 fixedly connected by pins (not shown) to the main ring 38 so as to be rotated together.

The main ring 38 and the auxiliary ring 39 are provided along their inner peripheries with threads 40, 41, respectively, which are of directions opposite to each other, and engaged with the previously mentioned threads 35, 36 of the upper and lower stops 31, 32, respectively, as seen in FIG. 1. Since the main ring 38 and the auxiliary ring 39 are integrally connected to each other so as to be rotated together as has previously been mentioned, rotation of the main ring 38 and the auxiliary ring 39 in one direction causes the upper and lower stops 31, 32 to move in close to each other while rotation of these rings 38, 39 in the opposite direction causes the stops 31, 32 to go away from each other.

Now a liquid feed apparatus utilizing such liquid feed pumps to perform the operation of liquid medicine filling will be described.

Figure 5:
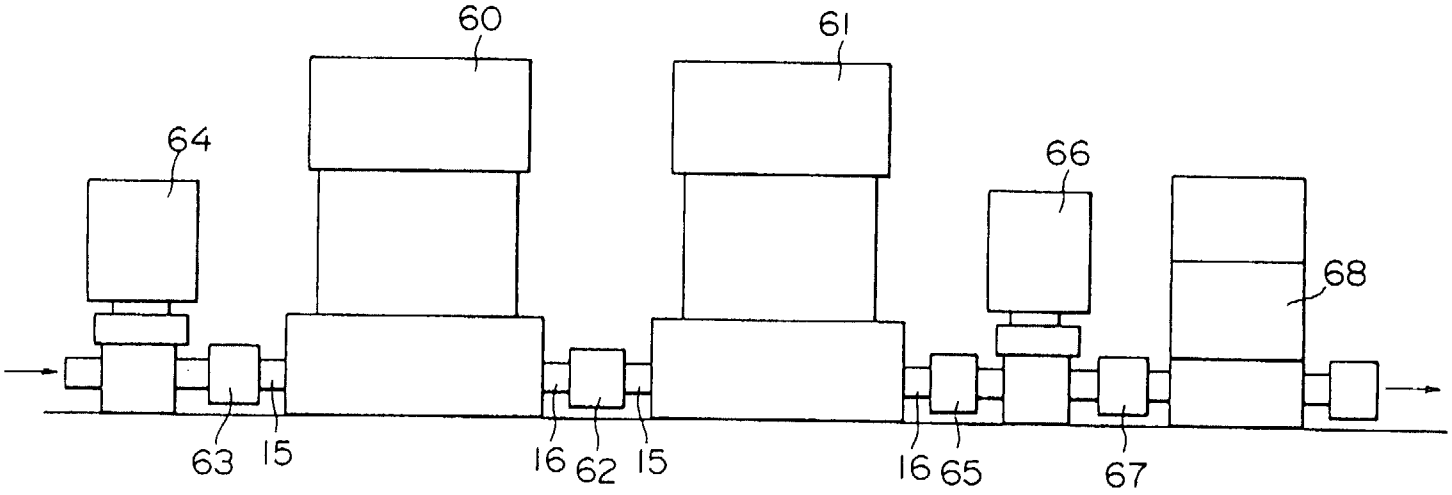
FIG. 5 is a schematic diagram of a liquid feed apparatus used for operation of liquid medicine filling, comprising a pair of liquid feed pumps each shown by FIG. 1 and a suck-back pump successively connected one to another in this order.

FIG. 5 schematically illustrates such apparatus.

A pair of liquid feed pumps 60, 61 are serially connected to each other by serially connecting the liquid outlet 16 of the first liquid feed pump 60, a gasket 62 and the liquid inlet 15 of the second liquid feed pump 61 in this order. A stop valve 64 is connected to the liquid inlet 15 of the first liquid feed pump 60 via a gasket 63. The liquid medicine is fed from a reservoir (not shown) provided upstream of the stop valve 64. A stop valve 66 is connected to the liquid outlet 16 of the second liquid feed pump 61 via a gasket 65 and a suck-back pump 68 is connected to the downstream side of the stop valve 66 via a gasket 67. Though not shown, a filter and filling nozzle used to fill ampules or the like with the liquid medicine are connected to the downstream side of the suck-back pump 68.

It should be understood that the suck-back pump 68 may be of the same construction as the liquid feed pumps 60, 61.

The liquid feed system of the above-mentioned construction operates as will be described. After the upstream stop valve 64 is opened and the downstream stop valve 66 is closed, the compressed air is introduced through the lower air passage 29 into the cylinder chamber 27 of each liquid feed pump 60, 61, causing the stem 25 to move upward and thereby increasing a volume of the pump chamber 14 so that the liquid medicine may be introduced into the pump chamber 14 through the liquid inlet 15.

Then the upstream stop valve 64 is closed and the downstream stop valve 66 is opened, followed by introducing the compressed air into the upper air passage 28 into the cylinder chamber 27 of each liquid feed pump 60, 61. Thus, the stem 25 is moved downward and thereby a volume of the pump chamber 14 is decreased so that the liquid medicine may be discharged from the pump chamber 14 through the liquid outlet 16.

The liquid medicine discharged from the pump chamber 14 then passes through the suck-back pump 68 to the downstream filling nozzle through which the ampule or the like is filled with the liquid medicine.

Upon completion of filling, the downstream stop valve 66 is closed and a small quantity of liquid medicine remaining in the filling nozzle is sucked back by the suck-back pump 68. Thereupon a cycle of filling is completed without a dripping of liquid medicine from the ampule or the like which has been filled with the liquid medicine.

The same operation may be repeated to fill a number of ampules or the like with the liquid medicine.

During the operation of filling (i.e., during discharge of the liquid medicine), the suck-back pump merely serves as a passage for the liquid medicine while the volume of the diaphragm is being decreased and, upon completion of filling, the suck-back pump functions to increase the volume of the pump chamber and thereby sucks back a small quantity of liquid medicine remaining in the filling needle tip in order to avoid a dripping of the liquid medicine.

A quantity of the liquid medicine to be fed (i.e., a quantity of the liquid medicine with which an ampule or the like is to be filled) depends on the number of liquid feed pumps serially connected one to another and the stroke of the stem 25 controlled by the upper and lower stops 31, 32 in each of these liquid feed pumps.

For example, if two or three liquid feed pumps are serially connected one to another, a quantity of the liquid medicine to be fed will be doubled or trebled, respectively. In each of the liquid feed pumps, the ring 37 may be adjustably rotated to change a distance between the upper and lower stops 31, 32 so as to change the stroke of the stem 25 and thereby to achieve a fine adjustment of the quantity of the liquid medicine to be fed. More specifically, the main ring 38 and the auxiliary ring 39 are provided around their inner peripheries with the threads 40, 41, respectively, which are reversely threaded to each other. These threads 40, 41 are adapted to be engaged with the threads 35, 36 provided around the outer peripheries of the upper and lower stops 31, 32, respectively, which are reversely threaded to each other. Accordingly, rotation of the ring 37 causes the upper and lower stops 31, 32 to be vertically moved along the rods 33 so as to go in close to or go away from each other. Since all the threads have a same pitch, the amount of movement of the upper and lower stops 31, 32 is always the same. In this manner, the upper and lower stops 31, 32 may be spaced from the plate 30 mounted on the stem 25 adjacent the upper end thereof by adjustably rotating the ring 37 and thereby the stroke of the stem 25, and therefore the quantity of the liquid medicine to be fed may be adjusted.

After the stroke of the stem 25 has been adjusted, the screw 34 is threaded in the upper stop 31 until the lower end of the screw 34 sufficiently depresses the upper surface of the lower stop 32 by the ball **34*a* to assure that the upper and lower stops 31, 32 are biased to be kept apart from each other and thereby stabilized. The depressing effect of the screw 34 assures also that the thread 40 of the main ring 38 is firmly engaged with the thread 35 of the upper stop 31 and the thread 41 of the auxiliary ring 39 is firmly engaged with the thread 36 of the lower stop 32, thus preventing the ring 37 from being further rotated and stabilizing the stroke of the stem 25**.

It should be understood that, if the suck-back pump 68 illustrated in FIG. 5 is constructed in the same manner as the liquid feed pump, a quantity of the liquid medicine to be sucked back can be adjusted in the same manner as adjustment for the liquid feed pump.

The entire surface of the pump chamber 14 destined to be exposed to the liquid medicine may be subjected to electrolytic polishing, as in the present embodiment, to facilitate washing and to make CIP (Clean In Place) as well as SIP (Sterile In Place) possible without dismantling.

Since the liquid inlet 15 as well as the liquid outlet 16 are arranged so as to slope downwardly as they extend away from the pump chamber 14, no liquid medicine remains within the pump chamber after the operation of filling has been completed and washing is facilitated.

In view of the fact that the diaphragm is generally characterized by high thrust and low suction, the reservoir for storage of the liquid medicine may be located at a high level or the liquid medicine may be supplied under a pressure to the liquid feed pump for the liquid feed system arranged as shown by FIG. 5 to lighten the burden of the diaphragm and thereby to extend the life span of the pump.

The liquid feed pumps, the stop valves and the other components may be placed upright in the liquid feed system to facilitate drawing out of air from the pumps and the valves.

While the invention has been particularly shown and described with reference to a preferred embodiment thereof, it will be understood by those skilled in the art that from the foregoing changes in form and details can be made without departing from the spirit and scope of the invention.

What is claimed is:

1. In a liquid feed pump for pumping liquid medicine having a pump chamber, a diaphragm therein, a fluid inlet and a fluid outlet therefor, an inlet valve and an outlet valve, and a stem operably connected to the diaphragm and provided with a drive means adapted to reciprocate the stem and diaphragm in an upward travel and a downward travel during a stroke of the stem, the improvement comprising a pair of adjustable stops for adjustably limiting the upward travel and the downward travel of the stem and the diaphragm during a stroke thereof, and adjusting means for adjusting a position of each of the stops of the pair of stops such that the upward travel and the downward travel of the stem and diaphragm are correspondingly adjustably limited, wherein the diaphragm is a metal diaphragm and the adjusting means moves each of the stops of the pair of stops an equal amount in opposite directions during a change of each said position.

2. Liquid feed pump according to claim 1, wherein the stem is provided with a plate so that a movement of said plate is limited by the pair of stops.

3. Liquid feed pump according to claim 2, wherein the stops are provided with threads which are reversely threaded with respect to each other.

4. Liquid feed pump according to claim 3, wherein screw means are used to adjust a distance between the stops and to fix said distance.

5. Liquid feed pump according to claim 1 , wherein the stem carries a piston which is, in turn, vertically moved within a cylinder chamber so as to reciprocate said stem.

6. Liquid feed pump according to claim 5, wherein compressed air is introduced into the cylinder chamber in order to move the piston in a reciprocating manner.

* * * * *